United States Patent [19]

Cline

[11] 3,975,105

[45] Aug. 17, 1976

[54] SHEET LIFTER WITH PUNCHES FOR LOOSELEAF BOOK

[75] Inventor: Robert C. Cline, Saugerties, N.Y.

[73] Assignee: F. L. Russell Corporation, Mount Marion, N.Y.

[22] Filed: Apr. 29, 1975

[21] Appl. No.: 572,714

[52] U.S. Cl. ..... 402/1; 30/358; 402/4; 402/24

[51] Int. Cl.[2] ..... B42F 13/40; B26F 1/00

[58] Field of Search ..... 402/1, 7, 25, 4, 24; 30/358, 316

[56] References Cited

UNITED STATES PATENTS

| | | | |
|---|---|---|---|
| 1,285,048 | 11/1918 | Cooke | 402/1 X |
| 1,505,775 | 8/1924 | Gail | 30/358 |
| 2,105,233 | 1/1938 | Schade | 402/1 X |
| 2,445,440 | 7/1948 | Klemm | 402/1 X |
| 3,087,498 | 4/1963 | Vogel | 402/2 |
| 3,303,564 | 2/1967 | Hendricks | 402/1 X |

FOREIGN PATENTS OR APPLICATIONS

| | | | |
|---|---|---|---|
| 1,104,022 | 2/1968 | United Kingdom | |
| 1,146,001 | 3/1969 | United Kingdom | 402/25 |

*Primary Examiner*—Jerome Schnall

*Attorney, Agent, or Firm*—Hopgood, Calimafde

[57] ABSTRACT

This invention provides a special sheet lifter in a looseleaf notebook, and means associated with the sheet lifter for punching openings in an unperforated sheet at locations that fit the ring spacing of the looseleaf book. A flap portion hinged to the main body portion of the sheet lifter swings about a hinge line of a punch and die structure for making holes in any sheet at spacings for receiving the rings of the looseleaf book with which the sheet lifter is a part.

7 Claims, 5 Drawing Figures

SHEET LIFTER WITH PUNCHES FOR LOOSELEAF BOOK

BACKGROUND AND SUMMARY OF THE INVENTION

Looseleaf binders, especially those having rings of large diameter, are equipped with sheet lifters for preventing the paper pages of the book from catching under the rings and being torn when the binder is moved from open to closed position.

The conventional sheet lifter comprises a relatively stiff panel with elongated openings through which the rings of the binder extend. The sheet lifter extends for substantially the full height of the sheets that are bound in the binder and extends crosswise of the sheets far enough, when the book is in open position, to raise those portions of the sheets which are in any danger of catching under the rings as the book is closed.

This invention provides a sheet lifter of unique construction with provisions for punching holes in unperforated sheets, with the holes spaced as necessary in order to be bound into the looseleaf binder of which the sheet lifter is a part.

The sheet lifter has the stiffness necessary to perform its lifting function; but it also has a hinge line, some distance from the rings of the binder, about which a flap portion of the sheet lifter can swing into a position overlapping the main body portion of the sheet lifter. Punches on the flap engage openings in the body portion of the sheet lifter to punch holes in a sheet which is placed with its edge embraced between the flap portion and main body portion at the hinge line.

The sheet lifter of this invention is made in such a way that it is inexpensive and flat enough so that it does not interfere with the normal functioning of the sheet lifter.

Other objects, features and advantages of the invention will appear or be pointed out as the description proceeds.

BRIEF DESCRIPTION OF DRAWING

In the drawing, forming a part hereof, in which like reference characters indicate corresponding parts in all the views.

DESCRIPTION OF PREFERRED EMBODIMENT

Figure 1:
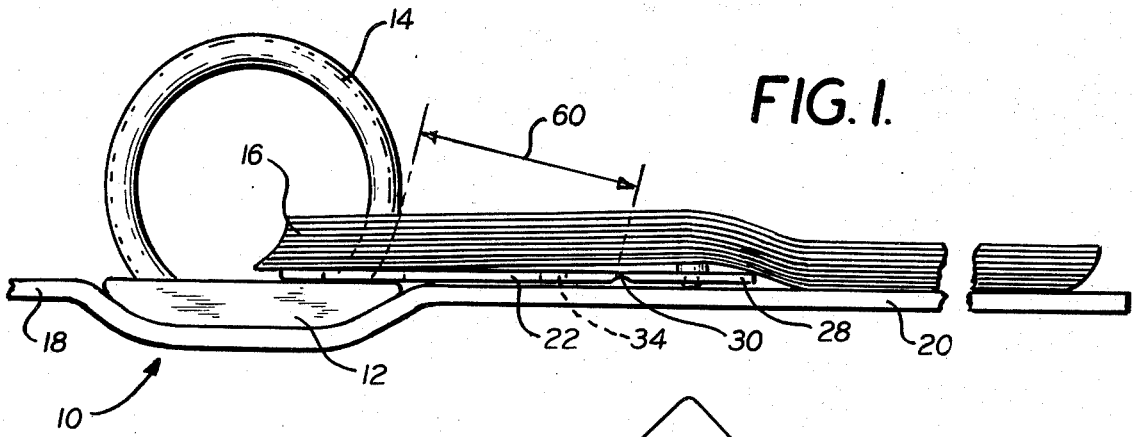
FIG. 1 is a diagrammatic, fragmentary end view of a looseleaf binder equipped with a sheet lifter made in accordance with this invention.

FIG. 1 shows a looseleaf binder 10 having a spine portion 12 that holds rings 14. FIG. 1 shows one ring 14 and the invention will be described in connection with a three-ring binder. It will be understood, however, that it can be used with ring binders having any number of rings. Sheets 16 are held in the binder by the rings 14. These sheets are usually made of paper.

The binder 10 has a front cover 18, only a portion of which is shown in FIG. 1. It also has a back cover 20 and these covers swing into parallel positions with respect to one another when the binder is closed. A sheet lifter 22 is located between the sheets 16 and the back cover 20. This sheet lifter 22 is held in the binder by the rings 14 and as the back cover 20 is swung upwardly to close the binder, the sheet lifter 22 moves the sheets 16 upward along the rings 14 so that none of the lowermost sheets 16 can catch under the rings 14 and be torn loose as the binder is closed.

The structure thus far described is conventional and well understood and no further description of it is necessary in order to fully understand the present invention.

Figure 2:
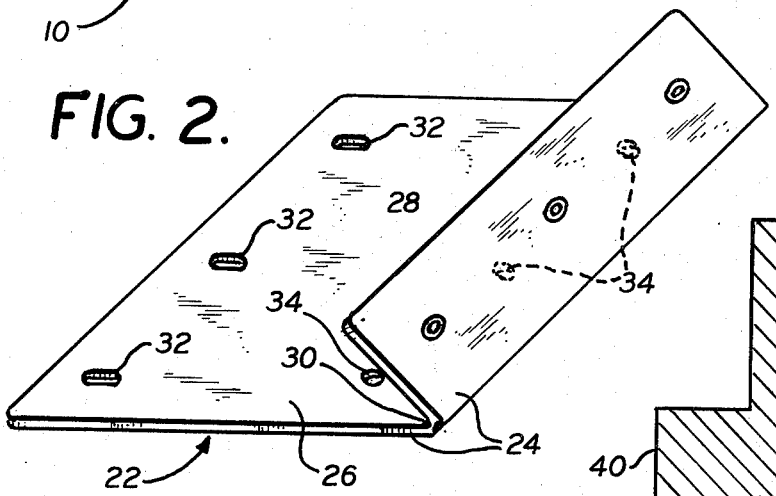
FIG. 2 shows the sheet lifter removed from the looseleaf binder and with the flap portion hinged up at an acute angle to the main body portion.

FIG. 2 shows the sheet lifter 22 when not located in the binder. It includes a panel 24 which has a main body portion 26 and a flap portion 28 which are preferably of one-piece construction and connected together by a hinge line 30. The panel 24 is relatively stiff, except at the hinge line 30; and it is preferably made of plastic material having good hinge characteristics so that it will not fracture or tear as the result of repeated bending back and forth along the hinge line 30.

There are openings 32 in the main body portion 26 in position to receive the rings 14 of the binder. These openings 32 are elongated in the direction of the planes of the rings which extend through them. This prevents the sheet lifter from binding on the rings when it is swinging upward or downward with the opening and closing of the binder. Such openings 32 are conventional in sheet lifters.

There are other openings 34 in the main body portion 26 of the sheet lifter. These openings 34 which may be referred to as die openings are at the same spacing from one another as the openings 32. Only one of these die openings 34 is visible in FIG. 2 but the others are shown in dotted lines since they are hidden by the flap portion 28 of the sheet lifter.

Figure 4:
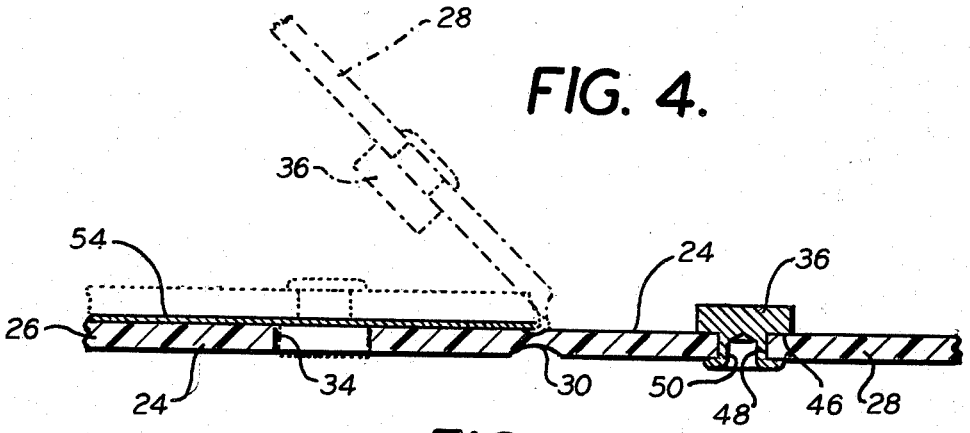
FIG. 4 is an enlarged sectional view of a portion of the sheet lifter adjacent to the hinge line and showing also one of the punches and one of the die openings with which the punch cooperates.

The hinge line 30 is best shown in FIG. 4. It is a depression in the underside of the panel 24 which makes the panel thinner and flexible along the hinge line 30. In the preferred and illustrated construction, the depression 30 is confined to the underside of the panel 34 so that the axis about which the hinge action takes place is near the top surface of the panel 34 and this permits the flap portion 28 to move into a position more nearly parallel to the top surface of the sheet lifter when swung from the solid line position shown in FIG. 4 into the dotted line position shown in the same figure. An intermediate position, corresponding to that shown in FIG. 2, is shown in FIG. 4 in broken lines. The dimensions in FIG. 4 are greatly exaggerated for clearer illustration.

Figure 3:
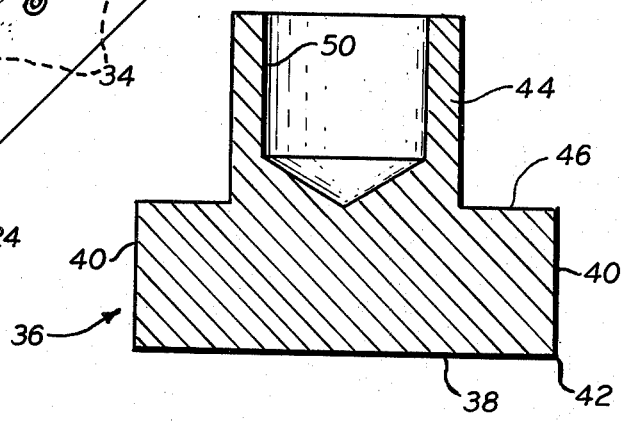
FIG. 3 is a greatly enlarged sectional view of one of the punches which is attached to the flap portion by riveting.

There is a projection or punch 36 associated with each of the die openings 34. The punches 36 are preferably made of metal and constructed as shown in the greatly enlarged sectional view of FIG. 3. This figure shows the punch 36 in sectional view before it is attached to the sheet lifter.

The punch 36 has a working face 38 and a cylindrical side wall 40. These surfaces meet at a circular line 42 which is a sharp corner in the illustrated construction. Since the punch 36 does not move in actual alignment with the axis of the die opening with which it cooperates, the shape of the juncture line 42 and the adjoining surfaces can be transferred or otherwise modified to compensate for the direction of movement of the punches with respect to the axis of the die openings. However, such modified construction adds to the cost of the invention and has proved to be unnecessary in practice.

The punch 36 has a stem portion 44 which is of less diameter than the working face 36; and this leaves a broad shoulder 46 which contacts with a face of the flap portion of the sheet lifter when the stem 44 is inserted through an opening in the flap portion 28. This opening is designated by the reference character 48 in FIG. 4.

The stem portion 44 has a counterbore 50 extending for most of the length of the stem portion 44; and the stem portion 44 is longer than the depth of the opening 48 so that the stem 44 extends somewhat beyond the end of the opening 48. With the shoulder 46 pressed firmly against the top face of the sheet lifter, the portion of the stem beyond the bottom face of the sheet lifter is riveted over against the bottom surface of the sheet lifter to secure the punch 36 in firm and rigid relation to the flap portion 28 of the sheet lifter.

When the flap portion 28 is swung into a position making an angle of 90° or less with the main body portion 26, a sheet of paper 54 can be pushed into position between the flap portion 28 and the main body portion 26, as shown in FIG. 4. The sheet 54 contacts with the material along the hinge line and this locates the sheet 54 so that holes punched in it by punches 36 will have the same spacing from each other and from the edge of the sheet as do the sheets for which the ring binder is intended.

Figure 5:
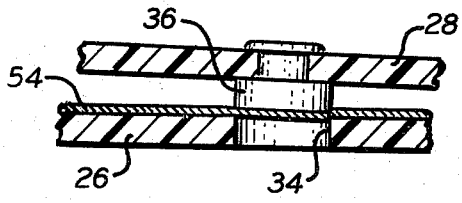
FIG. 5 is a fragmentary detail view showing the way in which the punch of FIG. 4 cooperates with the die opening to displace a disc of paper from a paper sheet in which openings for rings are formed by the punch.

FIG. 5 shows the punch 36 as it begins to sever the paper sheet 54. The punch 36 makes a clean cut of the paper 54 around the top edge of the opening 34. The disc of paper which is thus severed from the sheet 54 is pushed downwardly through the opening 34. In the preferred construction, the punch 36 is somewhat longer than the depth of the opening 34 so that the paper disc severed from the sheet 54 is pushed completely out of the opening 34. Thus any loose punchings from the paper can be discarded immediately after the punching operation instead of having them accumulate in the opening 34 and come out at unexpected times and places. It is not necessary, however, to have the punch 36 long enough to push the discs of paper out of the opening 34 and if a shorter punch 36 is desired so as to reduce the overall thickness of the sheet lifter when in its flat position shown in FIG. 1, then the punch 36 can be made shorter so long as it is substantially more than the thickness of the paper sheet 54. It is also necessary that the punch 36 be long enough so that the entire circumference of its working face passes completely through the paper regardless of the fact that the flap portion 28 is not completely parallel with the main body portion 26 at the start of the punching operation.

It is not necessary to remove the sheet lifter from the ring binder in order to use it to punch openings in a letter or other document which it is desired to bind into the ring binder. For example, all of the sheets 16 in FIG. 1 could be swung over into contact with the front cover 18 leaving the sheet lifter 22 lying against the back cover 20 as shown in FIG. 1. The flap portion 28 could then be moved upward into a position such as the broken line position shown in FIG. 4. The sheet 54 could then be inserted into the position shown in FIG. 4 where the edge of the sheet contacts with the hinge line of the sheet lifter. The portion of the sheet 54 which extends from the hinge line over the opening 34 must be flat and it should be flat for a distance from the hinge line equal to the width of the flap portion 28; but beyond that the sheet 54 can curve upwardly to clear the rings 14 (FIG. 1).

There is one important limitation on the length of the flap portion 28 with respect to the distance of the hinge line 30 from the rings 14. The maximum width of the flap portion 28 which carries the punches 26 must not be greater than the distance from the hinge line axis to the closest part of the rings 14 to the hinge line axis. This critical distance is indicated in FIG. 1 by the dimension line 60.

If the flap portion 28 were any longer than the dimension line 60, the outer edge of the flap portion would strike against the rings 14 and the flap portion could not fold down into a position parallel with the main body portion of the sheet lifter. This would prevent the punches 36 from reaching the die openings 34.

In order to have the invention operate conveniently while the sheet lifter is attached to the binder by the rings 14, it is preferable to have the flap portion 28 equal to approximately one-half of the distance 60. In the construction illustrated the flap portion 28 is slightly more than half of the distance 60, but it is enough shorter to leave plenty of room for a sheet of paper to bend upwardly ahead of the rings 14 while it is being punched by the punches 36 carried by the flap portion 28.

The material of which this invention is constructed is not critical. The preferred construction uses a plastic sheet lifter with good flexibility at the hinge line and uses metal punches that are riveted to the sheet lifter. The punches can be made of other material, such as stiff plastic and they can be held in place by adhesive. The construction can also be made by having the sheet lifter molded, as by injection molding, and in such a case the punches can be of one-piece construction with the flap portion of the sheet lifter.

Various other changes and modifications can be made and some features can be used in different combinations without departing from the invention as defined in the claims.

What is claimed is:

1. A sheet lifter for a looseleaf, ring binder book comprising a stiff elongated panel having a hinge line extending lengthwise thereof and dividing the panel into a main body portion and a flap portion, the main body portion having elongated openings adjacent the edge opposite the hinge line and being elongated in a direction at right angles to said edge for receiving the rings of a binder, the main body portion and flap portion normally lying in the same plane for functioning as a sheet lifter, and the main body portion being substantially wider than the flap portion in a direction at right angles to the hinge line, the flap portion being movable about the hinge line as an axis and into different angular positions up to substantially 180° with respect to the main body portion and overlying said main body portion, a plurality of openings through the panel and along a line spaced from and parallel to the hinge line, punches connected with the panel along another line spaced from and parallel to the hinge line but on the other side of the hinge line from the line of openings, the line of openings and the line of punches being at the same distance from the hinge line, said elongated openings, said plurality of openings and said punches being in alignment in a direction at right angles to said hinge line so that the punches register with the respective openings when the flap portion is swung substantially 180° into a position overlapping and adjacent to and substantially parallel with the main body portion and holes punched in a sheet will have the same spacing as the elongated openings, the punches fitting snugly into the respective openings for punching holes through a sheet disposed between the openings and the punches, the hinge line of the sheet lifter being stiff enough to hold the main body portion of the panel and the flap portion thereof in substantial alignment when no force is being applied to the flap portion to swing it angularly about the hinge line as an axis.

2. The structure described in claim 1 characterized by the flap portion, when swung up at an angle of approximately 90° or more, with respect to the main body portion, being a stop against which an edge of a sheet of paper can be held in position with respect to the openings and punches for locating the openings punched in the sheet at a uniform spacing from the edge of the sheet.

3. The structure described in claim 1 characterized by the panel being made of one piece of sheet material and of less thickness at the hinge line.

4. The structure described in claim 1 characterized by rings of a looseleaf binder extending through said elongated openings in the main body portion of the panel, the width of the flap portion being less than the shortest distance from the hinge line to any of the rings when the rings are in contact with the ends of the elongated openings that are closest to the hinge line.

5. The structure described in claim 1 characterized by each of the punches being secured to the flap portion and having a head which is substantially cylindrical and that snugly fits into one of the openings in the main body portion of the panel, which openings serve as dies that cooperate with the punches, the openings being in position to overlie a back cover of a book in which the sheet lifter is connected with the binder rings and lies on the inside surface of a cover of the binder.

6. The structure described in claim 5 characterized by each of the punches being a rivet, each rivet having a stem portion of less diameter than the head so as to leave an annular shoulder where the stem joins the head, the shoulder contacting with the top surface of the flap portion, the stem extending through the panel and having its end remote from the head spread radially outward to contact the bottom surface of the flap portion of the panel to secure the rivet to the panel, the stem of the rivet being hollow from a location spaced from the rivet head by a distance less than the thickness of the panel, and the portion of the hollow stem beyond the bottom of the front portion of the panel being the part of the rivet that is spread radially outward to contact the bottom surface of the front portion of the panel.

7. The structure described in claim 1 characterized by the panel being made of plastic material with the openings through said plastic material free of any reinforcement around the circumferences of the openings, and said plastic material being hard enough for the punches to sever discs of paper from paper sheets sheared between the edges of the openings and the circumferences of the punches.

* * * * *